US006584875B1

(12) United States Patent
Deng

(10) Patent No.: US 6,584,875 B1
(45) Date of Patent: Jul. 1, 2003

(54) RATCHET WRENCH

(76) Inventor: Jackson Deng, 3Fi-7, No. 5, Alley 40, Yung Ping South Road, Tai Ping City, Taichung Hsien (TW)

( * ) Notice: Subject to any disclaimer, the term of this patent is extended or adjusted under 35 U.S.C. 154(b) by 0 days.

(21) Appl. No.: 10/190,530

(22) Filed: Jul. 9, 2002

(51) Int. Cl.[7] ..... B25B 13/46
(52) U.S. Cl. ..... 81/63.1; 81/60
(58) Field of Search ..... 81/63.1, 60, 61, 81/62, 63.2

(56) References Cited

U.S. PATENT DOCUMENTS

| | | | | | |
|---|---|---|---|---|---|
| 731,886 | A | * | 6/1903 | George | 192/43.2 |
| 2,107,568 | A | * | 2/1938 | Haist | 192/43.1 |
| 2,193,984 | A | * | 3/1940 | Rhinevault | 192/43.2 |
| 2,803,980 | A | * | 8/1957 | Vogel | 315/77 |
| 2,957,377 | A | * | 10/1960 | Hare | 192/43.2 |
| 3,598,001 | A | * | 8/1971 | Thomasian | 81/63.1 |
| 5,140,875 | A | * | 8/1992 | Kim | 81/124.4 |
| 5,174,176 | A | * | 12/1992 | Krivec | 81/62 |
| 5,450,773 | A | * | 9/1995 | Darrah et al. | 81/57.39 |
| 6,164,167 | A | | 12/2000 | Chen | 81/63.2 |
| 6,279,428 | B1 | * | 8/2001 | Huang | 192/43.2 |
| 6,382,052 | B1 | * | 5/2002 | Chen | 81/63 |

* cited by examiner

*Primary Examiner*—Joseph J. Hail, III
*Assistant Examiner*—Hadi Shakeri
(74) *Attorney, Agent, or Firm*—Troxell Law Office PLLC

(57) ABSTRACT

A ratchet wrench including: a handle having a head section formed with a circular hole and a cavity; a ratchet wheel rotatably installed in the circular hole; two left and right symmetrical dogs side by side arranged in left and right sides of the cavity, an inner end of each dog being formed with a recess, the two recesses of the dogs being positioned opposite to each other to form a receiving space; two resilient members respectively disposed between the wall of the cavity and the two dogs, when not suffering external force, the resilient members resiliently forcing the dogs toward the ratchet wheel to engage therewith; a shifting member having symmetrical left and right ends which are respectively disposed in the two recesses of the two dogs; and a rotary switch connecting with the shifting member. When turning the rotary switch, the shifting member is angularly displaced to push one dog away from the ratchet wheel, while making the other dog resiliently engaged with the ratchet wheel.

8 Claims, 6 Drawing Sheets

RATCHET WRENCH

BACKGROUND OF THE INVENTION

The present invention is related to a hand tool, and more particularly to a ratchet wrench including a rotary switch for controlling two dogs to engage with the ratchet wheel.

A conventional ratchet wrench includes a ratchet wheel and a dog member engaged with the ratchet wheel for one-way rotating the ratchet wheel. Some of the ratchet wrenches are equipped with direction switches for changing the position of the dog member. Therefore, the dog member can engage with left side or right side of the ratchet wheel to control the rotational direction of the ratchet wheel. In a ratchet wrench free from the direction switch, the dog member is kept in a fixed position where the dog member is engaged with the ratchet wheel. A user must operate the wrench from front side or back side to change the rotational direction of the ratchet wheel.

U.S. Pat. No. 6,164,167 "ratchet wrench having gear driven pawl" discloses a ratchet wrench having a direction toggle switch. A first, a second and a third recesses 121, 122, 123 are disposed in the head 11 of the wrench 10 and communicate with each other. A ratchet wheel 20, a toothed pawl 30 and a shifting block 41 are respectively received in said three recesses 121, 122, 123. Resilient members 51, 52 resiliently abut against the shifting block 41. The direction toggle switch 42 is connected with the shifting block 41. When turning the switch 42, the shifting block 41 is rotated to drive and move the toothed pawl 30 so as to change the engagement position of the toothed pawl and the ratchet wheel. Accordingly, the rotational direction of the ratchet wheel of the wrench can be controlled.

In the above conventional ratchet wrench having direction switch, only one pawl is disposed for engaging with the ratchet wheel.

Moreover, in the above ratchet wrench, the head 11 is formed with three recesses 121, 122, 123 for respectively accommodating therein the ratchet wheel 20, toothed pawl 30 and shifting block 41. As a result, the volume of the head 11 is enlarged and it is inconvenient to use such ratchet wrench. Furthermore, the manufacturing procedure is complicated. In addition, the top face of the head is hollow and covered by a cover board 70. This reduces the structural strength of the head.

SUMMARY OF THE INVENTION

It is therefore a primary object of the present invention to provide a ratchet wrench including a rotary switch for controlling two dogs to engage with the ratchet wheel and change the rotational direction of the ratchet wheel.

It is a further object of the present invention to provide the above ratchet wrench in which the head section of the handle of the ratchet wrench has minified volume.

It is still a further object of the present invention to provide the above ratchet wrench in which the structural strength of the head section is enhanced.

The present invention can be best understood through the following description and accompanying drawings wherein:

DETAILED DESCRIPTION OF THE PREFERRED EMBODIMENTS

Figure 1:
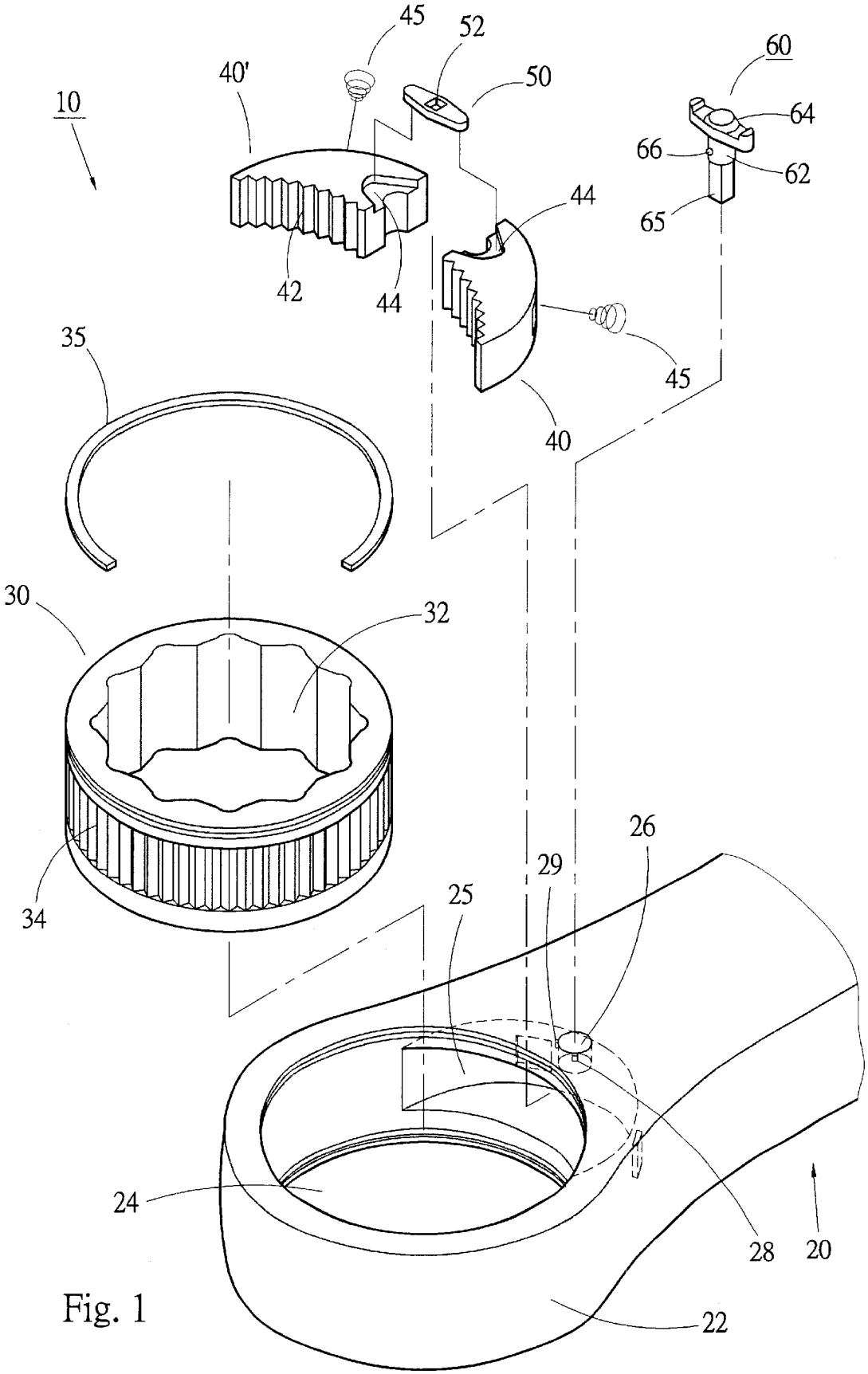
FIG. 1 is a perspective exploded view of a preferred embodiment of the present invention.
Figure 2:
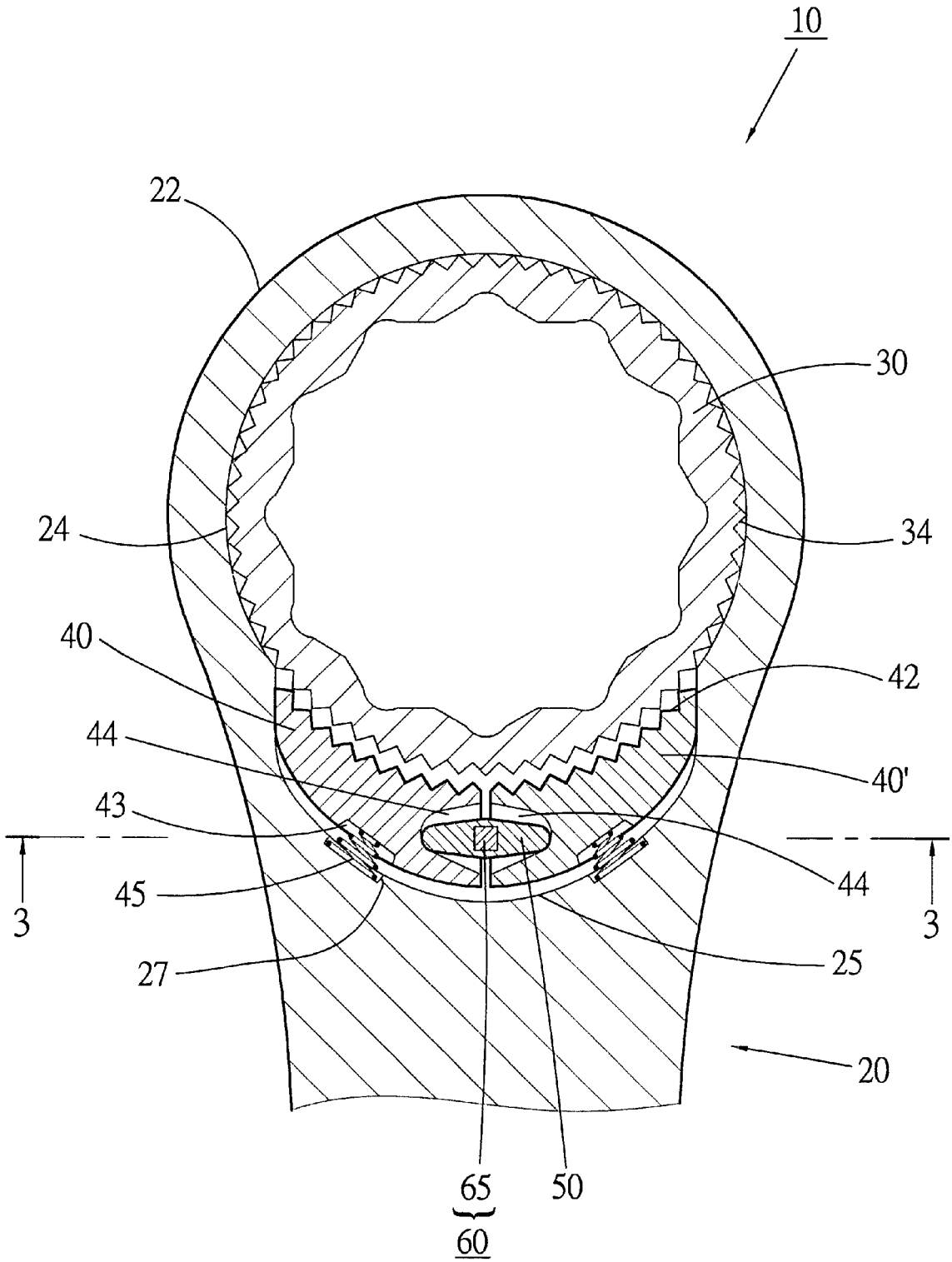
FIG. 2 is a sectional assembled view of the present invention.

Please refer to FIGS. 1 and 2. According to a preferred embodiment, the ratchet wrench 10of the present invention includes a handle 20, a ratchet wheel 30, two dogs 40, 40', two springs 45, a shifting member 50 and a rotary switch 60.

One end of the handle 20 has a head section 22 formed with a circular hole 24 passing through the head section from upper side to lower side thereof. The circumferential wall of the circular hole is formed with a cavity 25 extending to rear end of the handle. A shaft hole 26 is formed on top face of the handle 20 and inward extends to communicate with the cavity 25. The shaft hole 26 is right positioned at the center of the cavity.

The ratchet wheel 30 is used to directly or indirectly fit onto a screwed member such as a bolt or a nut. For example, the ratchet wheel can be provided with a column for inserting into a socket. Alternatively, the ratchet wheel can be formed with a polygonal fitting hole 32 for fitting onto a screwed member. The outer circumference of the ratchet wheel is formed with multiple continuous teeth 34. The ratchet wheel 30 is rotatably installed in the circular hole 24 and located by a C-shaped retainer ring 35 which pertains to prior art.

Figure 3:
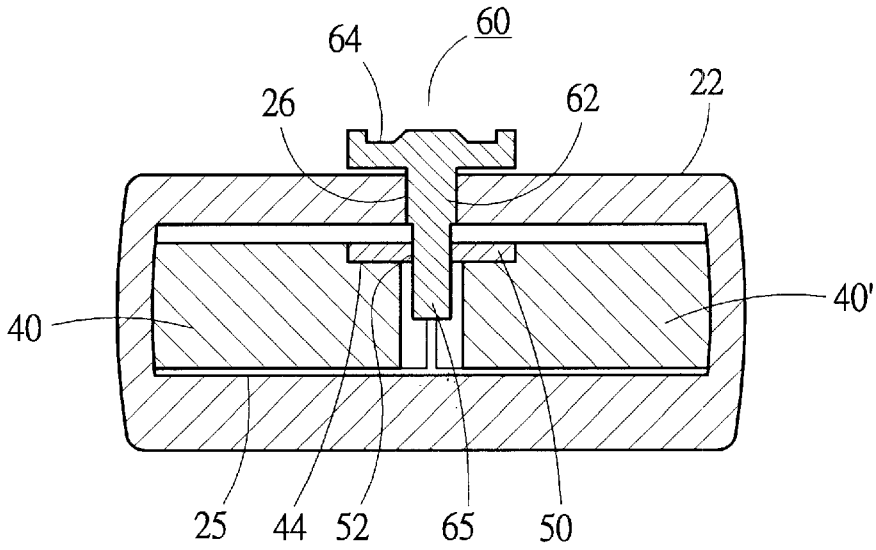
FIG. 3 is a sectional view taken along line 3—3 of FIG. 2.
Figure 7:
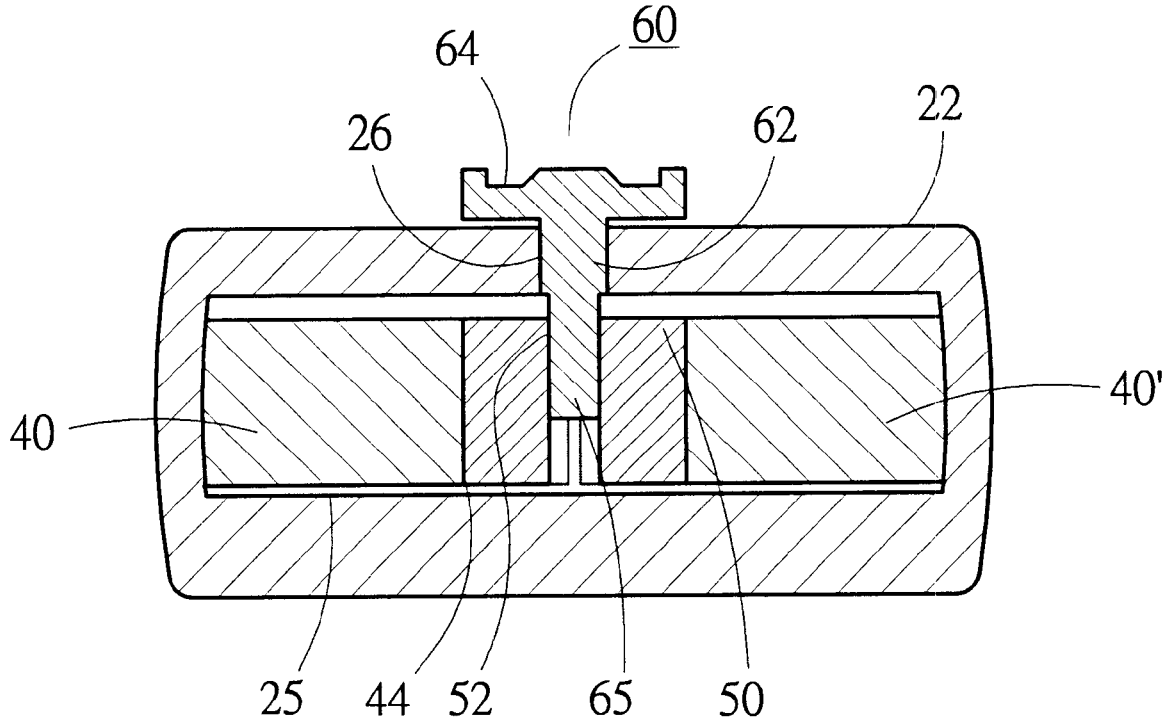
FIG. 7 is a sectional view taken along line 3—3 of FIG. 2, showing an alternative embodiment of the recess and the shifting member.

The two dogs 40, 40' are received in the cavity 25 and side by side arranged in left and right sides of the cavity 25. The two dogs are left and right symmetrical to each other. The front face of the dog is formed with teeth 42 arranged in an arched form. The rear face of each dog is formed with a dent 43. The inner end of the dog (opposite the other dog) is formed with a recess 44. In this embodiment, the top face of each dog is downward depressed by a certain depth, as shown in FIG. 3, to form the recess without passing through the dog. However, practically, the recess can alternatively pass through the dog from top face to bottom face thereof as illustrated in FIG. 7. As shown in FIG. 2, when the two dogs are left and right side by side arranged, the recesses 44 are opposite to each other to form a receiving space.

The two springs 45 are respectively received in two sides of the cavity 25. The front ends of the springs abut against the dents 43 of the dogs 40. The rear ends of the springs abut against dents 27 formed on the wall of the cavity. When not suffering external force, the springs resiliently force the dogs toward the ratchet wheel 30.

The shifting member 50 can be a plate member or a block body with a predetermined thickness, depending on the depth of the recess. The shifting member has as slender cross-section. The lengthwise direction of the shifting member is perpendicular to the longitudinal direction of the handle. A left and right end of the shifting member are symmetrical to each other. The center of the shifting member is formed with a polygonal insertion hole 52. The shifting member 50 is disposed in the cavity 25 and positioned in the recesses 44 of the two dogs.

The rotary switch 60 has a stem-like shaft section 62 and a rotary section 64 disposed at top end of the shaft section 62. The bottom end of the shaft section 62 is formed with a polygonal insertion section 65. The shaft section 62 of the rotary switch 60 is inserted through the shaft hole 26 and downward extends into the cavity 25. The insertion section 65 is inserted in the insertion hole 52 of the shifting member 50 for angularly driving and displacing the shifting member 50. The rotary section 64 is positioned on outer side of the handle 20 for a user to manually operate. A fixing section 66 is formed on the shaft section 62 for engaging with two locating sections 28, 29 disposed on the circumferential wall of the shaft hole 26.

In the operation position as shown in FIG. 2, the shifting member 50 (and the rotary section 64 of the rotary switch) is in a horizontal state. At this time, the left and right ends of the shifting member 50 abut against the recesses 44 of the dogs 40 so that the two dogs are kept at the same height. It should be noted that in the state of FIG. 2, selectively, both the dogs can be disengaged from the ratchet wheel 30 or engaged with the ratchet wheel 30. In the case that both the dogs are disengaged from the ratchet wheel, the ratchet wheel will idle. Reversely, in the case that both dogs are engaged with the ratchet wheel, the ratchet wheel cannot be rotated.

Figure 5:
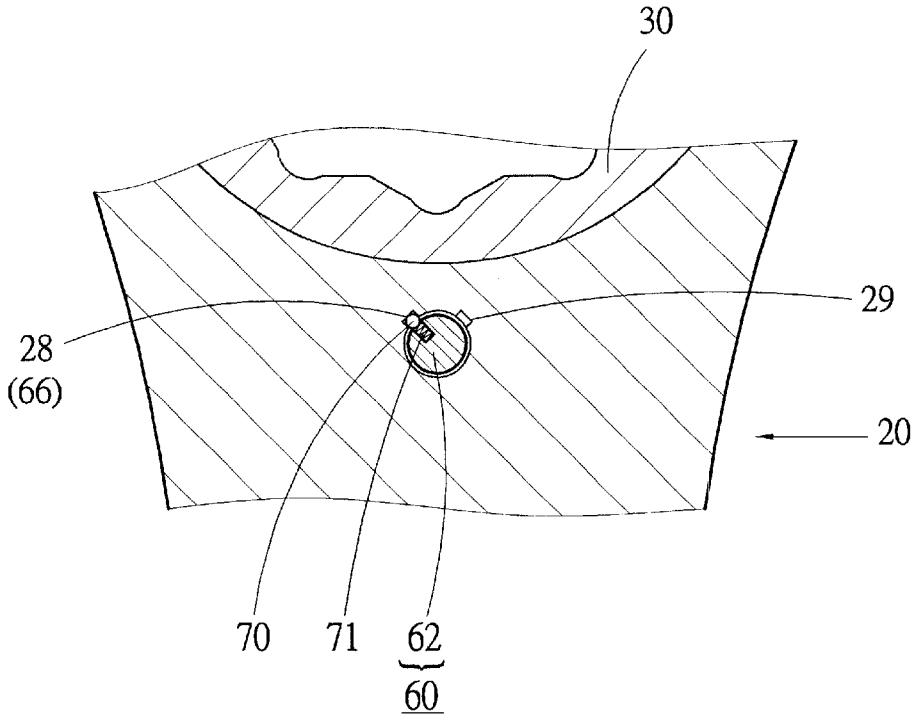
FIG. 5 is a sectional view showing the location of the rotary switch of the present invention.
Figure 4:
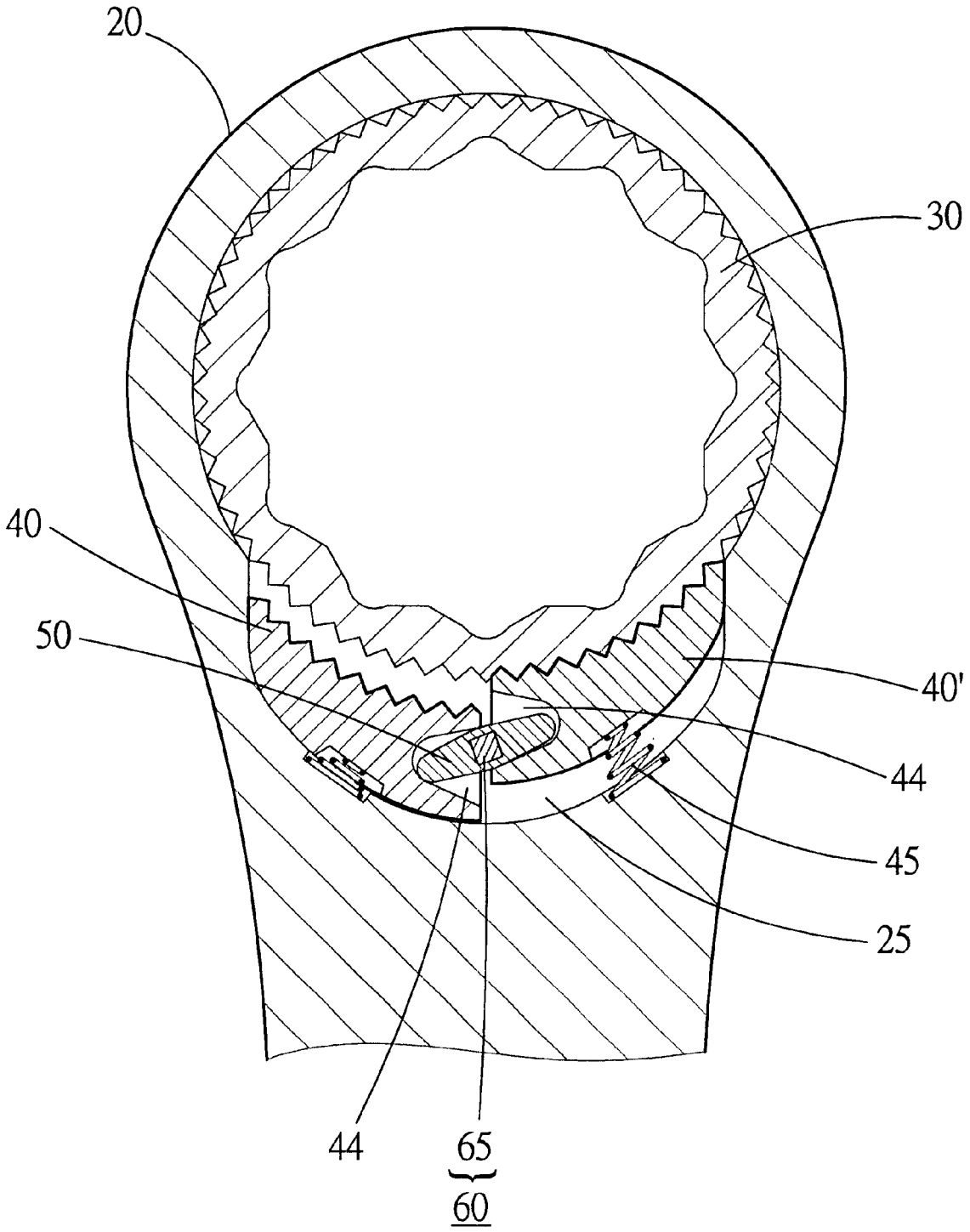
FIG. 4 is a sectional view showing the operation of the present invention in one state.

Referring to FIGS. 4 and 5, when counterclockwise turning the rotary section of the rotary switch 60, the shifting member 50 is driven to counterclockwise rotate as shown in FIG. 4. The fixing section 66 of the shaft section 62 is engaged in the locating section 28. At this time, the rotary switch and the shifting member are located in an operation position as shown in FIG. 4. In this state, the left end of the shifting member 50 downward pushes the left dog 40 away from the ratchet wheel 30. The right dog 40' is not restricted by the shifting member and is resiliently forced by the spring 45 to keep engaging with the ratchet wheel 30. Under such circumstance, the engagement between the ratchet wheel and the dog 40' provides ratchet effect in a rotational direction, that is, the ratchet wheel cannot be counterclockwise rotated, while being one-way clockwise rotatable. Each time the ratchet wheel is clockwise rotated by one pitch, the dog 40' resiliently jumps away from the ratchet wheel and re-engages with the ratchet wheel.

Figure 6:
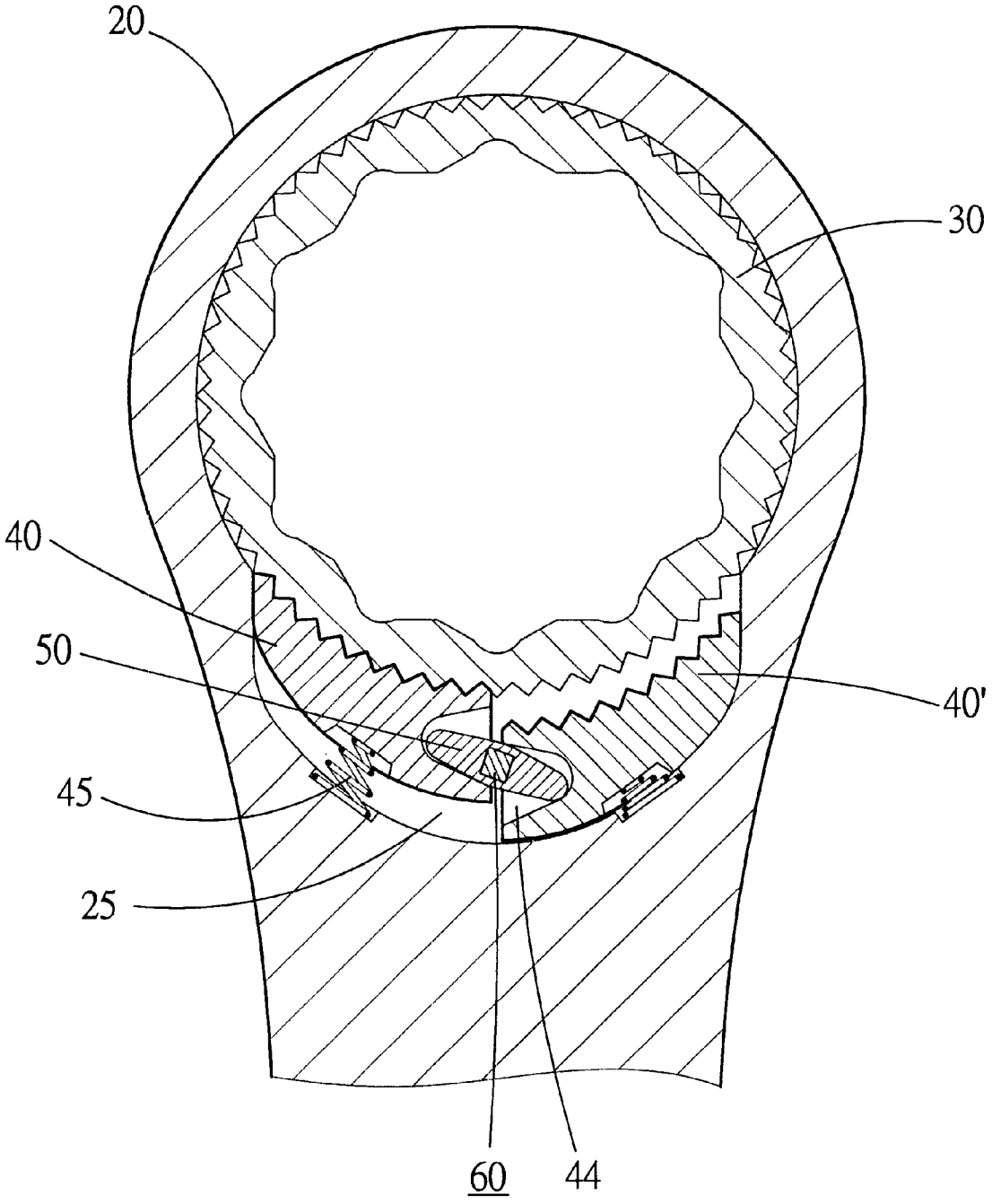
FIG. 6 is a sectional view according to FIG. 4, showing the operation of the present invention in another state.

When an operator clockwise turns the rotary switch 60, the shifting member 50 is angularly displaced into a state as shown in FIG. 6. At this time, the fixing section 66 is engaged in the other locating section 29 so that the rotary switch and the shifting member are located in another operation position. In the state of FIG. 6, the right dog 40' is downward pushed by the shifting member 50 away from the ratchet wheel 30. The left dog 40 is not restricted by the shifting member and is resiliently forced by the spring 45 to engage with the ratchet wheel 30. Under such circumstance, the engagement between the ratchet wheel and the dog 40 provides a ratchet effect in another rotational direction, that is, the ratchet wheel cannot be clockwise rotated, while being one-way counterclockwise rotatable.

According to the operation states of FIGS. 4 and 6, the direction of the ratchet effect of the wrench is changeable for tightening or untightening a screwed member.

It should be noted that a third locating section can be additionally disposed on the circumferential wall of the shaft hole 26 between the two locating sections 28, 29. In the operation state of FIG. 2, the fixing section 66 of the rotary switch can be engaged with the third locating section to locate the shifting member.

In addition, a resilient assembly of a spring 71 and a ball body 70 can be embedded in the shaft section 62 of the rotary switch to form the fixing section for engaging with the locating section.

The ratchet wrench of the present invention has the following advantages:

1. The ratchet wrench of the present invention discloses a type of a rotary switch for controlling two dogs to change the rotational direction of the ratchet wheel. The ratchet wrench can be more truly operated.
2. The head section of the handle is only formed with a circular hole and a cavity so that the volume of the head section is not enlarged. This enables a user to operate the ratchet wrench in a narrow space.
3. The cavity of the head section is not hollow so that the structural strength of the head section is enhanced.

The above embodiments are only used to illustrate the present invention, not intended to limit the scope thereof. Many modifications of the above embodiments can be made without departing from the spirit of the present invention.

What is claimed is:

1. A ratchet wrench comprising:

a handle having a head section at one end of the handle, the head section has a circular hole passing through the head section from an upper side to a lower side thereof, a circumferential wall of the circular hole being formed with a cavity, a shaft hole being formed on a top face of the handle and communicating with the cavity, a wall of the shaft hole having a plurality of locating sections;

a ratchet wheel, an outer circumference of the ratchet wheel having multiple continuous teeth, the ratchet wheel being rotatably installed in the circular hole;

left and right symmetrical dogs received in the cavity and arranged side by side in a left and right side of the cavity, a face of each dog facing the ratchet wheel having teeth arranged in an arched form for engaging the teeth of the ratchet wheel, an inner end of each dog being formed with a recess, the two recesses of the dogs are positioned opposite to each other to form receiving spaces;

two resilient members in the cavity respectively, each acting on one of the two dogs to resiliently bias the dogs toward the ratchet wheel;

a shifting member having a symmetrical left and right end, the left and right ends of the shifting member are disposed in the recesses of the dogs, a center of the shifting member having an insertion hole; and, a rotary switch extending through the shaft hole into the cavity, a bottom end of a rotary section of the rotary switch including a shaft section, a bottom end of the shaft section is inserted into the insertion hole, the shaft section including a fixing device, whereby the fixing device is engaged with one of the plurality of locating sections.

2. The ratchet wrench as claimed in claim 1, wherein the rotary switch has at least two locating positions, such that when the rotary switch is in a first of the two locating positions, one of the left and right ends of the shifting member pushes a first of the left and right dogs away from the ratchet wheel, while a second of the left and right dogs is resiliently engaged with the ratchet wheel; and when the rotary switch is in a second of the at least two locating positions, another of the left and right ends of the shifting member pushes the second of the left and right dogs away from the ratchet wheel, and the first of the left and right dogs is resiliently engaged with the ratchet wheel.

3. The ratchet wrench as claimed in claim 2, wherein a resilient member and a ball body are embedded in the shaft section to form the fixing section.

4. The ratchet wrench as claimed in claim 1, wherein a top face of the inner end of each dog has a downward recess, and wherein the shifting member is a plate member located in the recess.

5. The ratchet wrench as claimed in claim 1, wherein the recesses pass through an inner end of each dog from a top face to a bottom face thereof, the shifting member is located in the recess.

6. The ratchet wrench as claimed in claim 1, wherein a face of each dog facing a circumferential wall of the cavity and is formed with a dent, and a first end of each resilient member is positioned in the dent.

7. The ratchet wrench as claimed in claim 6, wherein the circumferential wall of the cavity has second dents, each corresponding to the dent of each dog, and a second end of the resilient member is positioned in the second dent.

8. The ratchet wheel as claimed in claim 2, wherein the rotary switch has a third locating position between the first and second locating positions, such that when the rotary switch is located in the third position, the left and right dogs are in the same position relative to the ratchet wheel.

* * * * *